US005839525A

United States Patent [19]

Hoffmaster et al.

[11] Patent Number: 5,839,525

[45] Date of Patent: Nov. 24, 1998

[54] DIRECTIONAL DRILL BIT

[75] Inventors: Carl M. Hoffmaster; Tim P. Beaton; Keith Terry, all of Houston, Tex.

[73] Assignee: Camco International Inc., Houston, Tex.

[21] Appl. No.: 771,000

[22] Filed: Dec. 23, 1996

[51] Int. Cl.[6] ..... E21B 10/00; B21K 5/04

[52] U.S. Cl. ..... 175/375; 175/327; 175/331; 175/435; 76/108.4

[58] Field of Search ..... 76/108.4; 175/320, 175/327, 331, 375, 435

[56] References Cited

U.S. PATENT DOCUMENTS 4,054,772 10/1977 Lichte ..... 219/121 EM 4,275,285 6/1981 Jadach ..... 219/93

4,947,945 8/1990 Griffin ..... 175/409

*Primary Examiner*—David J. Bagnell

*Assistant Examiner*—Gary S. Hartmann

*Attorney, Agent, or Firm*—Fletcher, Yoder & Edward

[57] ABSTRACT

A roller cone or drag-type drill bit for use in drilling subsurface formations, especially useful for directional drilling, has a bit body with a shank portion for connection to a drill string, and a crown portion. Breaker slots are formed in the bit body at or immediately adjacent to the intersection of the crown portion and the shank portion. This location of the breaker slots allows the drill bit to be relatively shorter than comparable prior art bits with the breaker slots formed in the shank portion. The shorter length permits the present drill bit to be more easily steered in directional drilling applications.

19 Claims, 2 Drawing Sheets

DIRECTIONAL DRILL BIT

BACKGROUND OF THE INVENTION

1. Field of the Invention

The invention relates to rotary drill bits for drilling or coring holes in subsurface formations and, more particularly, to drill bits that adapted to be steered, as in directional drilling.

2. Description of Related Art

Around the world an increasing percentage of wells that are drilled in subterranean earthen formations in the pursuit of oil and gas are being drilled with non-linear trajectories. This type of drilling is commonly called "directional drilling", and requires great skill in causing the rotating bit to drill in a certain direction. To aid in this type of drilling, special bottom hole assemblies are used that have drill collars of certain weights and lengths, as well as stabilizers. One critical item of equipment that can dramatically influence the trajectory of the wellbore being drilled is the bit itself. Bit designers have long tried to design their bits to have predictable drilling characteristics so that the drilling operator at the earth's surface can more easily manipulate the trajectory of the wellbore.

Roller cone and drag-type drill bits have certain characteristics that make them more or less desirable for directional drilling. One such characteristic is a relatively short length, which means that it has a relatively shorter fulcrum length, that enables the drill bit to be offset or "steered" in a particular direction. A shorter drill bit has been found to be more "steerable" over a longer drill bit. It has been desired to design drill bits of short length for directional drilling purposes; however, due to the extreme forces that a drill bit is subjected to while drilling, the size and amount of structural material used in a drill bit cannot be reduced. There is a need for a drill bit that has the desired size and amount of structural material, yet has a relatively shortened length to enhance its directional drilling capabilities.

SUMMARY OF THE INVENTION

The present invention has been contemplated to overcome the foregoing deficiencies and meet the above described needs. In particular, the present invention comprises a rotary drill bit for drilling subsurface formations with a bit body with a shank extending therefrom for connection to a drill string. Breaker slots are formed in the drill bit at the intersection of the bit body with the shank, such as in the weld between the crown portion of the bit body and the shank. The breaker slots being located at the intersection permit the overall length of the drill bit to be reduced, thereby, creating a drill bit that can more easily be steered in directional drilling applications.

DETAILED DESCRIPTION OF THE PREFERRED EMBODIMENTS

As has been briefly described above, the present invention is a drill bit for use in drilling subsurface formations, especially useful for directional drilling applications. The present invention can be used with roller cone drill bits, as well as drag-type drill bits; however, for the purposes of the present discussion, it will be assumed that the present invention is a drag-type drill bit. Typical drag-type drill bits that the present invention can be used with are commonly referred to as natural diamond, TSP, and PDC drill bits.

Figure 1:
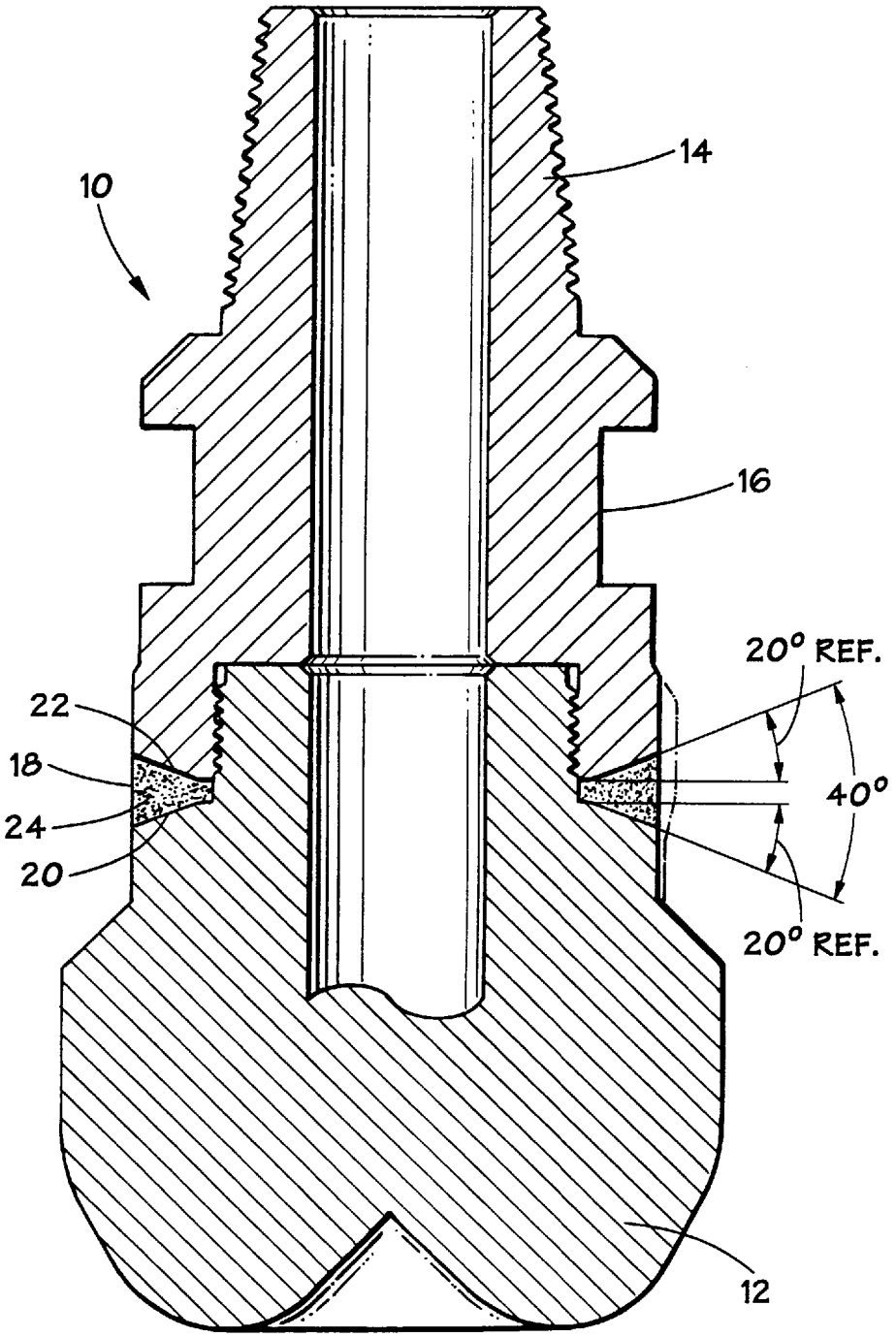
FIG.1 (PRIOR ART)
FIG. 1 is a cross-sectional elevational view of a drag type drill bit of the Prior Art, showing breaker slots spaced from the intersection of the bit body and the shank.

To aid in the understanding of the present invention, reference is made to a Prior Art drag-type drill bit 10 shown in FIG. 1. The drill bit 10 has a crown portion 12 machined from metal, usually steel, which may be hard faced. Alternatively the crown portion 12, or a part thereof, may be molded from matrix material using a powder metallurgy process. The methods of manufacturing drill bits of this general type are well known in the art and will not be described in detail. Not shown in FIG. 1 are the diamond cutting elements that extend from the crown portion 12 to engage and remove the earthen material during the drilling process. A threaded steel shank 14 extends from the bit body 10 for interconnection to a drill string, as is well known to those skilled in the art.

At least two parallel breaker slots or flats 16 are machined or formed at a location on the shank 14 spaced from an intersection 18 formed by a beveled annular surface 20 on an upper end of the crown portion 12 and a beveled annular surface 22 on a lower end of the shank 14. This intersection 18 usually has an inclusive angle of about 40 degrees, and is filled with weld material 24, as is well known to those skilled in the art.

When the drill bit 10 is to be threadedly connected to a drill string, relatively large tongs or a breaker plate (not shown) are slipped into the breaker slots 16, and the drill bit 10 is rotated with respect to the drill string. As shown in FIG. 1, the breaker slots 16 are located on the shank 14 at a location spaced from the intersection 18. This is desired to not place unnecessary stress or strain on the weld material 24, that could cause the destructive separation of the crown 12 from the shank 14 while drilling. For example, in a standard 6½ inch diameter PDC drill bit, the distance from the lowermost tip of the crown 12 to a location on the shank 14 immediately beyond the slots 16, can be about 8 inches to about 8¾ inches, with the distance between the intersection 18 and the center of the slots 16 being about 3 inches.

Figure 2:
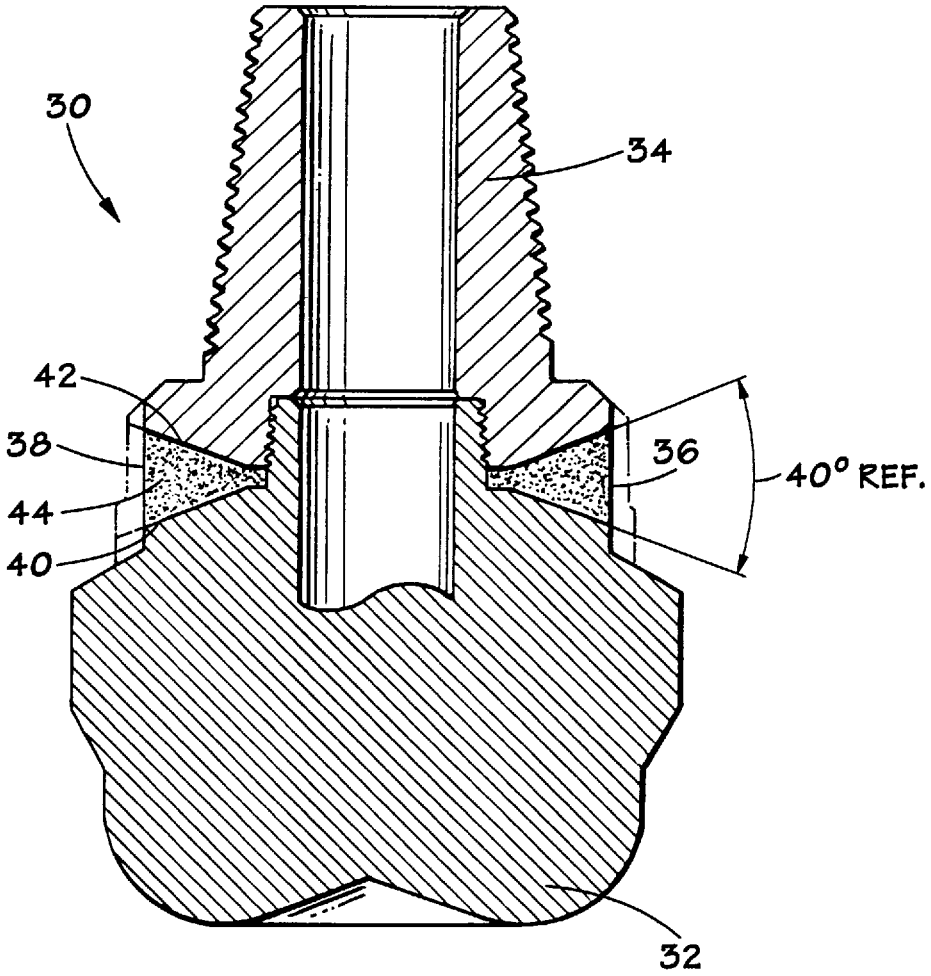
FIG. 2 is a cross-sectional elevational view of one preferred embodiment of a drill bit of the present invention, showing breaker slots at the intersection of the bit body and the shank.

As described above, it is desired to reduce the overall length of the drill bit as much as possible so that the drill bit can be more easily steered in directional drilling applications. The inventors hereof have found that a drill bit can be designed of significantly less length by forming the breaker slots at or immediately adjacent the intersection of the crown portion and the shank portion without sacrificing structural integrity. As shown in FIG. 2, a drill bit 30 has a crown portion 32 machined from metal, usually steel, which may be hard faced. Alternatively the crown portion 32, or a part thereof, may be molded from matrix material using a powder metallurgy process. The methods of manufacturing drill bits of this general type are well known in the art and will not be described in detail. A threaded steel shank 34 extends from the bit body 30 for interconnection to a drill string, as is well known to those skilled in the art.

At least two parallel breaker slots or flats 36 are machined or formed at a location on the shank 34 at or immediately adjacent to an intersection 38 formed by a beveled annular surface 40 on an upper end of the crown portion 32 and a beveled annular surface 42 on a lower end of the shank 34. This intersection 38 as before has an inclusive angle of about 40 degrees, and is filled with weld material 44, as is well known to those skilled in the art. The breaker slots 36 can be formed entirely in the crown portion 32 adjacent to the intersection 38, entirely in the shank portion 34 adjacent to the intersection, partially in the crown 32 and the weld 44, partially in the shank 34 and the weld 44, or preferably entirely in the weld 44.

The inventors hereof have found that with the weld materials commercially available, that no structural integrity has been lost by placing the slots 36 in the weld 44. Most importantly, the inventors have enabled the overall length of the drill bit 30 to be significantly reduced in comparison to comparable Prior Art drill bits. For example, as stated above, in a standard 6½ inch diameter PDC drill bit, the distance from the lowermost tip of the crown to a location on the shank immediately beyond the slots, can be about 8 inches to about 8¾ inches, with the distance between the intersection and the center of the slots being about 3 inches. With the present invention, this 3 inch distance can be removed so that when the slots 36 are located at the intersection 38 the distance from the lowermost tip of the crown 32 to a location on the shank 34 immediately beyond the slots 36, can be about 5 inches to about 5¾ inches.

This reduction of about 3 inches from the overall length of the drill bit does not at first appear to be significant, but the those skilled in the art realize that any shortening of the overall length of the drill bit can dramatically increase the ease that such a drill bit can be steered while drilling.

Whereas the present invention has been described in particular relation to the drawings attached hereto, it should be understood that other and further modifications, apart from those shown or suggested herein, may be made within the scope and spirit of the present invention.

What is claimed is:

1. A rotary drill bit for drilling subsurface formations, comprising:

a bit body having a crown portion and a shank portion, extending from the crown portion, for connection to a drill string; and breaker slots in the bit body formed at the intersection of the crown portion and the shank portion.

2. A rotary drill bit of claim 1 wherein the crown portion and the shank portion are joined by a weld, with the breaker slots formed substantially in the weld.

3. A rotary drill bit of claim 2 wherein an upper portion of the crown portion has a beveled surface adjoining a beveled surface in a lower portion of the shank portion, with the weld filling a space between the two adjoining beveled surfaces.

4. A rotary drill of claim 1 wherein the drill bit is a drag-type drill bit.

5. A rotary drill bit for drilling subsurface formations, the drill bit comprising:

a bit body having a crown portion and a shank portion, the shank portion extending from the crown portion for connection to a drill string, the crown portion and the shank portion being joined together at an intersection by a weld; and breaker slots in the bit body formed substantially in the weld at the intersection of the crown portion and the shank portion, wherein an upper portion of the crown portion has a beveled surface adjoining a beveled surface in a lower portion of the shank portion, with an inclusive angle between the adjoining beveled surfaces being about 40 degrees.

6. A drag-type rotary drill bit for drilling subsurface formations, comprising:

a bit body having a shank portion for connection to a drill string, and a crown portion; and breaker slots in the bit body formed at or immediately adjacent to the intersection of the crown portion and the shank portion.

7. A rotary drill bit of claim 6 wherein the crown portion and the shank portion are joined by a weld, with the breaker slots formed substantially in the weld.

8. A rotary drill bit of claim 7 wherein an upper portion of the crown portion has a beveled surface adjoining a beveled surface in a lower portion of the shank portion, with the weld filling a space between the two adjoining beveled surfaces.

9. A rotary drill bit of claim 6 wherein the crown portion is formed from a metallic matrix material and the shank portion is formed from a ferrous material.

10. A drag-type rotary drill bit for drilling subsurface formations, the drill bit comprising:

a bit body having a shank portion for connection to a drill string, and a crown portion, the crown portion and the shank portion being joined at an intersection by a weld; and breaker slots in the bit body formed at or immediately adjacent to the intersection of the crown portion and the shank portion, wherein an upper portion of the crown portion has a beveled surface adjoining a beveled surface in a lower portion of the shank portion, with an inclusive angle between the adjoining beveled surfaces being about 40 degrees.

11. A rotary drill bit for drilling in subterranean formations, the drill bit comprising:

a bit body having a shank portion and a crown portion, the shank portion being coupled to the crown portion by a weld; and breaker slots formed in the weld.

12. The drill bit, as set forth in claim 11, wherein the rotary drill bit is a directional drill bit.

13. The drill bit, as set forth in claim 11, wherein bit body has a diameter of about 6.5 inches and a length of no more than about 5.75 inches as measured from a lowermost tip of the crown portion to a location on the shank portion immediately beyond the breaker slots.

14. A rotary drill bit for drilling in subterranean formations, the drill bit comprising:

a bit body having a shank portion and a crown portion, the shank portion being coupled to the crown portion at a junction; and breaker slots formed in the bit body at the junction.

15. The drill bit, as set forth in claim 14, wherein the rotary drill bit is a directional drill bit.

16. The drill bit, as set forth in claim 14, wherein bit body has a diameter of about 6.5 inches and a length of no more than about 5.75 inches as measured from a lowermost tip of the crown portion to a location on the shank portion immediately beyond the breaker slots.

17. A rotary drill bit for drilling in subterranean formations, the drill bit comprising:

a bit body having a shank portion and a crown portion, the shank portion being coupled to the crown portion by a weld; and a plurality of breaker slots formed about the bit body, at least one of the breaker slots being formed in at least a portion of the weld.

18. The drill bit, as set forth in claim 17, wherein the rotary drill bit is a directional drill bit.

19. The drill bit, as set forth in claim 17, wherein bit body has a diameter of about 6.5 inches and a length of no more than about 5.75 inches as measured from a lowermost tip of the crown portion to a location on the shank portion immediately beyond the breaker slots.

* * * * *